United States Patent [19]

Elson

[11] 4,228,933

[45] Oct. 21, 1980

[54] PRESSURIZED FLUID-DISPENSING APPARATUS

[76] Inventor: James T. Elson, 55 The Street, Shalford, Guildford, England

[21] Appl. No.: 6,020

[22] Filed: Jan. 24, 1979

[30] Foreign Application Priority Data

Feb. 6, 1978 [GB] United Kingdom ..... 04731/78

[51] Int. Cl.[3] ..... B65D 83/14

[52] U.S. Cl. ..... 222/400.7

[58] Field of Search ..... 222/400.7, 402.16, 397, 222/394, 402.24, 399

[56] References Cited

U.S. PATENT DOCUMENTS

| | | | |
|---|---|---|---|
| 1,885,678 | 11/1932 | Boyer | 222/400.7 X |
| 2,090,334 | 8/1937 | Paasche | 222/400.7 X |
| 2,571,433 | 10/1951 | Fine et al. | 222/400.7 X |
| 2,621,830 | 12/1952 | Stow et al. | 222/400.7 X |
| 3,090,530 | 5/1963 | Peeps | 222/400.7 |

*Primary Examiner*—Stanley H. Tollberg
*Attorney, Agent, or Firm*—Sherman & Shalloway

[57] ABSTRACT

The invention relates to a pressurized fluid-dispensing apparatus which can be re-charged with a fluid to be dispensed and pressurized by a compressed gas and can find application as a replacement for the well-known aerosol spray cannister.

In a specific embodiment the apparatus includes a container having an aperture for charging the container with a liquid to be dispensed, first a valve resiliently biased towards a closed position and operable, in use, to dispense the liquid under pressure and second a valve for connecting the container temporarily to a compressor for pressurizing the contents of the container and in which the first and second valves are removable from the container to expose the aperture for charging the container with a liquid.

4 Claims, 3 Drawing Figures

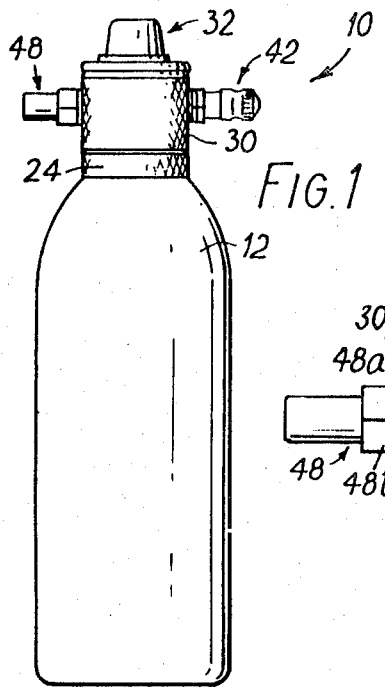
FIG. 1
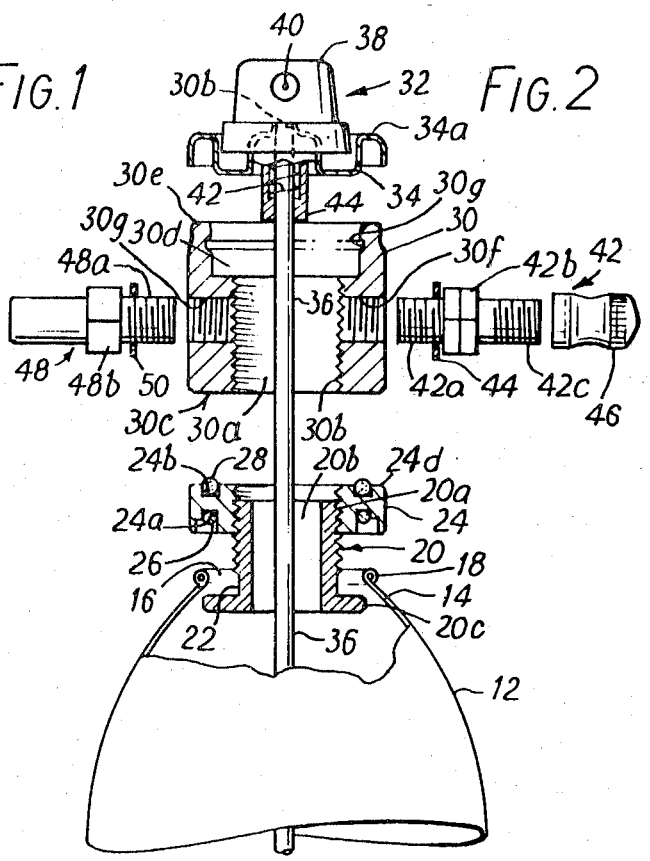
FIG. 2
FIG. 3
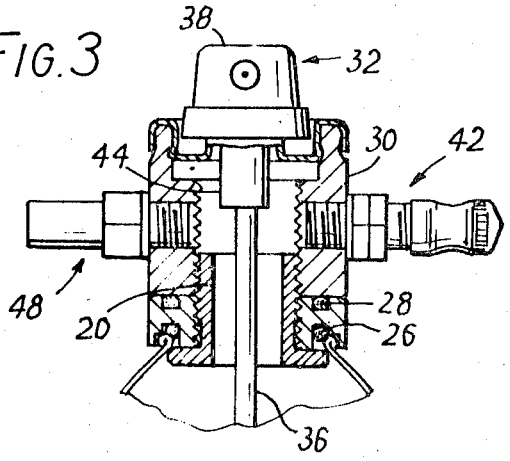

PRESSURIZED FLUID-DISPENSING APPARATUS

INTRODUCTION

This invention relates to pressurised fluid-dispensing apparatus for dispensing a liquid in the form of jet, spray or aerosol.

BACKGROUND OF THE INVENTION

There are available today many different liquid-dispensing apparatuses for dispensing a liquid in the form of a jet, spray or aerosol. Some typical apparatuses are aerosol cannisters which find wide application in the home and industry; lever operated devices, such as oil cans, which effectively squirt the liquid; paint-spray guns which are permanently connected to a source of compressed air during operation; sprays, such as garden sprays, in which the space above the liquid is pressurised by means of an integral hand pump, and beverages dispensing devices such as soda siphons in which the liquid is pressurised and sometimes aerated by coupling a cartridge of a compressed gas to a valve on the device to pressurise the contents of the device and then removing and discarding the cartridge before using the device. It has also been proposed to provide a re-fillable aerosol container which is recharged with a liquid under pressure but this necessitates the provision of a relatively large storage tank for the bulk liquid under pressure and complicated valve means for connecting the storage tank to the dispensing apparatus when it is required to re-charge the latter and venting means in the dispensing apparatus to vent the interior of the dispensing apparatus as it is re-charged.

There has long been a need for a relatively cheap, efficient and reliable liquid-dispensing apparatus for use in garages, factories, workshops and the like. There is also a need for such an apparatus which is relatively small and easily maneuverable so that a liquid can be dispensed towards parts where access is difficult; a typical requirement being for apparatus for dispensing a lubricating or penetrating oil on a part in a vehicle, machine or machine tool.

Aerosol cannisters have been used in such applications but they tend to be relatively expensive and wasteful in that it is not always possible to dispense all of the liquid in the cannister before the propellent gas is exhausted. In addition, there is the problem of ensuring that they are used in a safe manner and of their disposal. Apparatus with lever-operated dispensing means are also used in such applications but often they are incapable of dispensing the liquid at sufficient pressure and they lack manoeuvrability; apparatus with integral hand pumps tend to be bulky and the pressure which can be attained by the user tends to be limited; and spray guns permanently connected to a compressed-air line are difficult to maneuver. It is not known whether a device requiring a cartridge of a compressed gas to pressurise its contents has been used in the applications described in the immediately preceding paragraph but it seems doubtful in view of the need always to have available a supply of the relatively expensive cartridges and it is probable that their use has been mainly a domestic one for dispensing drinks.

SUMMARY OF THE INVENTION

According to the invention there is provided fluid-dispensing apparatus for dispensing a fluid in the form of a jet, spray or aerosol, the apparatus comprising a container, means for charging the container with a liquid to be dispensed, first valve means resiliently biased towards a closed position and operable, in use, to dispense the liquid under pressure and second valve means for connecting the container temporarily to a compressor for pressurising the contents of the container and in which the first and second valve means are removable from the container to expose an aperture for charging the container with a liquid.

The compressor may be, for example, an air compressor or a manually-operable device such as a foot pump and the second valve means may be connectable to the outlet of a standard compressed air line, such as a flexible hose typically found in a garage or workshop or the hose from a foot pump.

The second valve means may be of the kind used for motor vehicle tires and tire inner tubes, for example a Schrader valve.

The first valve means may be arranged to dispense a liquid in the form of a jet, spray or aerosol as required and, may be replaceable whereby a user of the apparatus can predetermine the manner in which the liquid is to be dispensed.

BRIEF DESCRIPTION OF THE DRAWINGS

The invention will now be described by way of example with reference to the accompanying drawings, in which:

FIG. 1 shows a side view of an embodiment of a liquid dispensing apparatus according to the invention, FIG. 2 shows an exploded, sectional view of part of the apparatus of FIG. 1 to a different scale, and FIG. 3 shows an assembled, sectional view of part of the apparatus of FIG. 1 to a different scale.

DETAILED DESCRIPTION

Referring to the drawing, there is shown a view of an apparatus 10 for dispensing a liquid in the form of a jet, spray or aerosol.

The apparatus 10 comprises a cylindrical container 12 having a neck 14 with an aperture 16 through which the container can be charged with a liquid to be dispensed.

The beaded rim 18 of the neck 14 has an adaptor 20 fitted thereto, the rim 18 being fitted into a peripheral groove 22 formed in the adaptor 20 and the adaptor 20 is secured in place by screwing an internally threaded ring 24 on the externally threaded part **20*a* of the adaptor, a flange 20*c* abutting the inner surface of bead 18 and a rubber or plastic O-ring 26 being interposed between the rim 18 and ring 24 to effect a good seal, the ring 24 being provided in its lower face with an annular groove 24*a* in which the O-ring 26 is seated. The ring 24 is also provided with an annular groove 24*b* in its upper face to seat a rubber or plastics O-ring 28. The adaptor 20 has an axial aperture 20*b* therethrough which communicates with the inside of the container 12** to facilitate charging of the container with a liquid to be dispensed.

A generally cylindrical valve holder body 30 has an axial aperture **30*a* having a threaded part 30*b* dimensioned to screw on the externally threaded part 20*a* of the adaptor 20 such that the end 30*c* abuts the shoulder 24*d* on the ring 24, the O-ring 28 in groove 24*b* effecting a good seal between the ring 24 and body 30. The aperture 30*a* opens out at its other end into an aperture 30*d* which is dimensioned to receive a valve 32**, such as an aerosol valve, for dispensing liquid.

The valve 32 has a generally cup-shaped portion 34 which is push fit in the aperture 30*d*. The top 34*a* of the wall of the cup-shaped portion 34 is turned over and formed round the generally convex part 30*e* of the body 30 and a crimping tool is used to deform a part of the wall into a peripheral groove 30*g* formed in the wall of the aperture 30*d* to secure the valve 32 in position. Protruding through an aperture 34*b* in the cup-shaped portion 34 is a flexible tube 36 dimensioned to extend at one end to near the bottom of the container 12 when the apparatus 10 is assembled. The other end of the tube 36 terminates in a conventional valve push button 38 having a dispensing nozzle 40 such as an aerosol nozzle. A compression spring 42 in a housing 44 depending from the under surface of the cup-shaped portion 34 is provided to spring load the valve 32 to a normally-closed position.

The body 30 is provided at its intermediate portion with a radially-extending, internally threaded aperture 30*f* dimensioned to receive an externally threaded end 42*a* of a valve 42. The valve 42 is provided with a peripheral flange 42*b* which acts as a stop to limit the intrusion of the valve 42 into the body 30, a fibre washer 44 being provided to effect a good seal. The valve 42 is, typically, a Schrader valve such as used for car tires and inner tubes, and is threaded at its other end 42*c* to receive a cap 46.

The body 30 is also provided at its intermediate portion with a radially-extending, internally threaded aperture 30*h* dimensioned to receive an externally threaded end 48*a* of a pressure-relief valve 48. The valve 48 is provided with a peripheral flange 48*b* which acts as a stop to limit the intrusion of the valve 48 into the body 30, a fibre washer 50 being provided to effect a good seal. The valve 48 is arranged to open slowly to release excess pressure in the container over a predetermined maximum value should the contents of the apparatus be over-pressurised by prolonged connection of valve 42 to a source of compressed air at a pressure above the predetermined value.

Peripheral parts of the ring 24 and the body 30 may be provided with flat parallel surfaces to facilitate removal of the body 30 by means of spanners or knurled when it is desired to charge the container 12 with a liquid.

In use, the body 30 with its valves 32 and 42 is removed from the adaptor 20 and the container 12 is charged with a liquid to be dispensed. The body 30 is then screwed on the adaptor and a compressed air line (not shown) from an air compressor is connected to the valve 42 to pressurise the contents of the container. The compressed air line is then disconnected from the valve 42 and the apparatus is ready for use, that is depression of push button 38 causes the liquid to be dispensed from nozzle 40 in a state determined by the kind of nozzle being used.

Air compressors typically found in a garage or workshop can deliver compressed air at a pressure of about 80 p.s.i. (56250 Kg/sq.m.) and it has been found that such a pressure is adequate to discharge the contents of a typically 200 or 450 gram container.

However, if the pressure is reduced to a value at which it is insufficient to dispense any liquid left in the container it is a simple matter to reconnect valve 42 to the compressed air line. In general it is thought that little or no liquid would be left in the container in which case it would be convenient to recharge the container 12 with liquid from a bulk supply of the liquid before reconnecting the valve 42 to the compressed air line.

Thus, there has been described an apparatus for dispensing a liquid which operates in a manner similar to the well-known aerosol dispenser but which is re-usable in a cheap and efficient manner in that the liquid can be purchased relatively cheaply in bulk and the container can be pressurised quite simply by connecting it to an air compressor.

As described the apparatus 10 has been designed to use available containers 12 but it will be realised that the container 12 and adaptor 20 could be made as an integral unit, when the ring 24 would be rendered unnecessary.

It is convenient to include the valves 32, 42 and 48 in the body 30 but other arrangements are possible. For example, the valve 48 could be fitted in the wall of the container.

For dispensing fluids having a relatively high viscosity such as an adhesive compound it may be preferable to mix them with a suitable low boiling point liquid, such as an aromatic compound, an aromatic compound with a hydroxyl compound, n-butyl alcohol (NBA), NBA with toluene or the like.

It is also possible to use the apparatus as a portable supply of a compressed gas, such as compressed air, and it has been found useful for blowing-out dust from small mechanisms, electronic equipment and the like.

I claim:

1. A portable liquid-dispensing apparatus for dispensing a liquid in the form of a jet, spray or aerosol, the apparatus comprising a container, a valve body having an annular top removably secured to the container whereby it can be removed to expose an aperture for charging the container with a liquid to be dispensed, first valve means mounted by a cup on said annular top of said valve body and resiliently biased towards a closed position, tube means for establishing fluid communication from near the bottom of the container to the first valve means, a manually operable push button on said valve body, a dispensing nozzle in a side wall of said push button communicating with said tube means wherein, in use, depression of said push button is arranged to open said first valve means to dispense the fluid under pressure, second valve means mounted on said valve body for connecting the container temporarily to an air compressor for pressurising the contents of the container, a third pressure relief valve means mounted on said valve body and arranged to open when the pressure in the container is greater than a predetermined valve.

2. The fluid-dispensing apparatus according to claim 1 wherein the second valve means is connectable to the outlet of a standard compressed air line.

3. The fluid-dispensing apparatus according to claim 1 or claim 2 in which the second valve means is a Schrader valve.

4. The fluid-dispensing apparatus of claims 1 or 2 in which the first valve means is replaceable whereby a user of the apparatus can predetermine the form in which the liquid is to be dispensed.

* * * * *